US006620022B1

(12) United States Patent
Smith et al.

(10) Patent No.: US 6,620,022 B1
(45) Date of Patent: Sep. 16, 2003

(54) DRIVE MECHANISM FOR TOY RACING CAR

(75) Inventors: Joseph Jay Smith, Elkins Park, PA (US); Tony Garr, Voorhees, NJ (US)

(73) Assignee: Connector Set Limited Partnership, Hatfield, PA (US)

( * ) Notice: Subject to any disclaimer, the term of this patent is extended or adjusted under 35 U.S.C. 154(b) by 0 days.

(21) Appl. No.: 10/158,508

(22) Filed: May 30, 2002

(51) Int. Cl.[7] ..... A63H 30/00

(52) U.S. Cl. ..... 446/454; 446/429; 446/457; 446/465

(58) Field of Search ..... 446/454, 429, 446/470, 462, 465, 460, 457

(56) References Cited

U.S. PATENT DOCUMENTS

| | | | | |
|---|---|---|---|---|
| 3,702,037 A | | 11/1972 | Toy et al. | |
| 3,757,459 A | | 9/1973 | Buck et al. | |
| 3,772,824 A | * | 11/1973 | Terzian et al. | |
| 3,984,939 A | * | 10/1976 | Wolgamot et al. | |
| 4,073,087 A | * | 2/1978 | Ieda | |
| 4,373,290 A | | 2/1983 | Goldfarb et al. | |
| 4,443,967 A | | 4/1984 | Jones et al. | |
| 4,498,886 A | * | 2/1985 | Goldfarb et al. | 446/202 |
| 4,556,397 A | | 12/1985 | Arad et al. | |
| 4,571,212 A | | 2/1986 | Kakizaki | |
| 4,580,994 A | | 4/1986 | Fauser et al. | |
| 4,596,534 A | | 6/1986 | Ishimoto | |
| 4,892,502 A | | 1/1990 | Hesse | |
| 4,892,503 A | | 1/1990 | Kumazawa | |
| 5,549,501 A | | 8/1996 | Jow | |
| 5,562,522 A | * | 10/1996 | Richno | 446/444 |
| 5,618,219 A | | 4/1997 | Simone et al. | |
| 5,916,007 A | | 6/1999 | Maxim | |

FOREIGN PATENT DOCUMENTS

| | | | |
|---|---|---|---|
| DE | 404465 | | 5/1923 |
| GB | 2 130 902 A | * | 6/1984 |

* cited by examiner

*Primary Examiner*—Derris H. Banks
*Assistant Examiner*—Ali Abdelwahed
(74) *Attorney, Agent, or Firm*—Schweitzer Cornman Gross & Bondell LLP

(57) ABSTRACT

A stand-alone drive mechanism for a toy racing car. The mechanism includes individually controlled motors for operating simulated main drive wheels of a race car vehicle, a semi-concealed actual drive wheel for the vehicle, and a steering system. The mechanism is principally intended for use in connection with a construction toy set such as "K'NEX," to enable construction of toy drag racing vehicles and the like. The simulated main drive wheels are elevated slightly above the support surface and can be rotated independently of the actual drive wheel, to simulate a "burn-out" sequence which typically precedes a drag race. By means of a remote radio control, the main drive wheels can be initially rotated to simulate "burn-out", followed immediately by operation of the actual drive wheel to send a vehicle down a race path. The stand-alone unit includes a pair of small stabilizing wheels which, together with the actual drive wheel, elevate the simulated main drive wheel slightly above the support surface to enable free rotation without movement of the vehicle. The control system includes an automatic timer for performing a "burn-out" and race sequence automatically.

14 Claims, 4 Drawing Sheets

DRIVE MECHANISM FOR TOY RACING CAR

BACKGROUND OF THE INVENTION

The present invention relates to toy vehicles and in particular to toy vehicles designed to simulate drag racers and the like.

Drag racing typically involves competition between two vehicles, starting side by side at a predetermined start signal, and racing along side-by-side racetracks for a predetermined distance. Typically, race cars of this type, shortly prior to the actual start, will spin their drive wheels on the pavement in what is referred to as a "burn-out." This heats up the surfaces of the drive wheel tires, which serves to increase the coefficient of friction between the drive wheels in the underlying pavement, minimizing spinning of the wheels when high torque levels are applied during high power starts.

In the design of toy vehicles, it is often desired to simulate real life. Accordingly, in a toy drag racer vehicle, for example, it would be desirable to simulate the pre-start procedures that are performed in real life. An example of such is the Fauser U.S. Pat. No. 4,580,994 in which a motor driven toy race car is provided with a "beater" activated by the car's drive motor. Using a shift lever, the motor can be activated to drive the beater to produce a staccato revving sound typical of pre-start activity. After the initial revving, a shift lever can be moved to engage the drive motor with the drive wheels. The present invention is directed to a toy-racing car designed to simulate a drag racer or the like in a different and improved manner.

SUMMARY OF INVENTION

The present invention is directed to a toy drag racer vehicle or the like, particularly one that is constructed in part utilizing "K'NEX" construction toy components, which enables a unique and advantageous form of pre-start simulation activities simulating burn-out of the drive wheels as typically occurs in the course of real drag racing practice. Pursuant to the invention, a special drive mechanism is provided which includes a chassis unit containing the drive motors and gears, control facilities, sound making elements and the like, and which includes mechanical facilities for joining the chassis unit with "K'NEX" construction toy components. The chassis unit includes a driven axle extending from each side thereof and mounting large wheels, simulating the main drive wheels of a typical drag racer. A pair of small stabilizing wheels are also mounted on the chassis, inside of and largely concealed by the large main wheels. The stabilizing wheels are positioned to project slightly below the lowermost peripheral portions of the simulated main drive wheels such that, in a normal orientation of the chassis unit, the simulated drive wheels are slightly elevated from a support surface on which the chassis unit is resting.

Additionally, the chassis unit mounts an actual drive wheel, which is housed primarily within the chassis unit and has a lower peripheral portion exposed at the bottom of the chassis unit. When the chassis unit is supported by the actual drive wheel and the two stabilizing wheels, the simulated main drive wheels are supported slightly above the level of the support surface and can be rotated without causing the chassis unit to move.

In accordance with one aspect of the invention, the chassis unit mounts separate drive motors for independent operation of the simulated drive wheels and the actual drive wheel, together with separate controls for the two motors, such that the simulated drive wheels can be rotated separately or simultaneously with the actual drive wheel. Preferably, the control arrangements include independent, manually operated control elements enabling the operator to control the "burn-out" and motion phases of the race car operation. Additionally, the control arrangements desirably include an automatic timer which, when actuated, initiates a sequence of a timed "burn-out" followed by race car motion.

In a particularly preferred embodiment of the invention, the drive motors are radio controlled by using a remote control pad, so that nothing on the simulated drag racer has to be physically manipulated in order to achieve the effects desired.

In one preferred embodiment of the invention, a power takeoff shaft is geared o the simulated main drive wheels, and can be connected via "K'NEX" construction, toy components to a simulated engine, with rotating elements, etc. to provide an increased level of realism. Additionally, a third drive motor is preferably mounted in the chassis unit. The third motor serves to actuate a linear control element projecting from the front of the chassis unit. When a complete race car vehicle is assembled, the linear control element can be joined with a steering mechanism at the front of the vehicle, to accommodate remote control steering as the vehicle advances.

For a more complete understanding of the above and other features and advantages of the invention, reference should be made to the detailed description of a preferred embodiment of the invention and to the accompanying drawings.

DESCRIPTION OF PREFERRED EMBODIMENT

Figure 1:
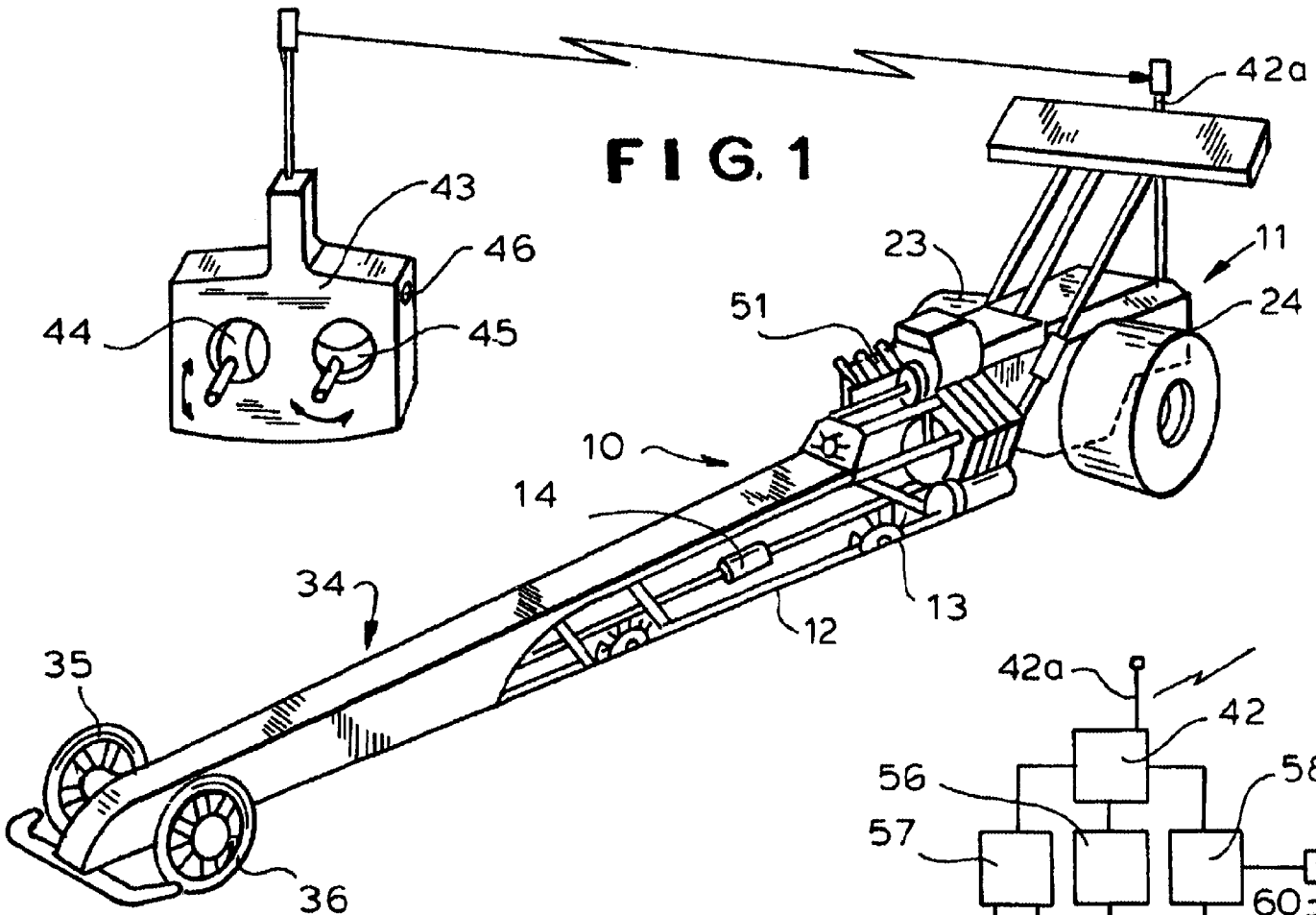
FIG. 1 is a simplified perspective view of a toy drag racer vehicle incorporating features of the invention and as constructed utilizing "K'NEX" construction toy components.

Referring now to the drawings, the reference numeral 10 designates generally a toy drag racer vehicle which incorporates a drive mechanism according to the invention, generally designated by the reference numeral 11. In the illustrated arrangement, the drive mechanism 11 is in the form of self-contained unit which is joined with an assembly of rods and connectors such as designated by the numerals 12–14, for example, to form an elongated vehicle simulating a drag racer. The present invention is directed principally toward the construction and operation of the drive mechanism 11, it being understood that a wide variety of vehicles can be constructed by joining of construction toy elements in various arrangements to the drive mechanism.

Figure 2:
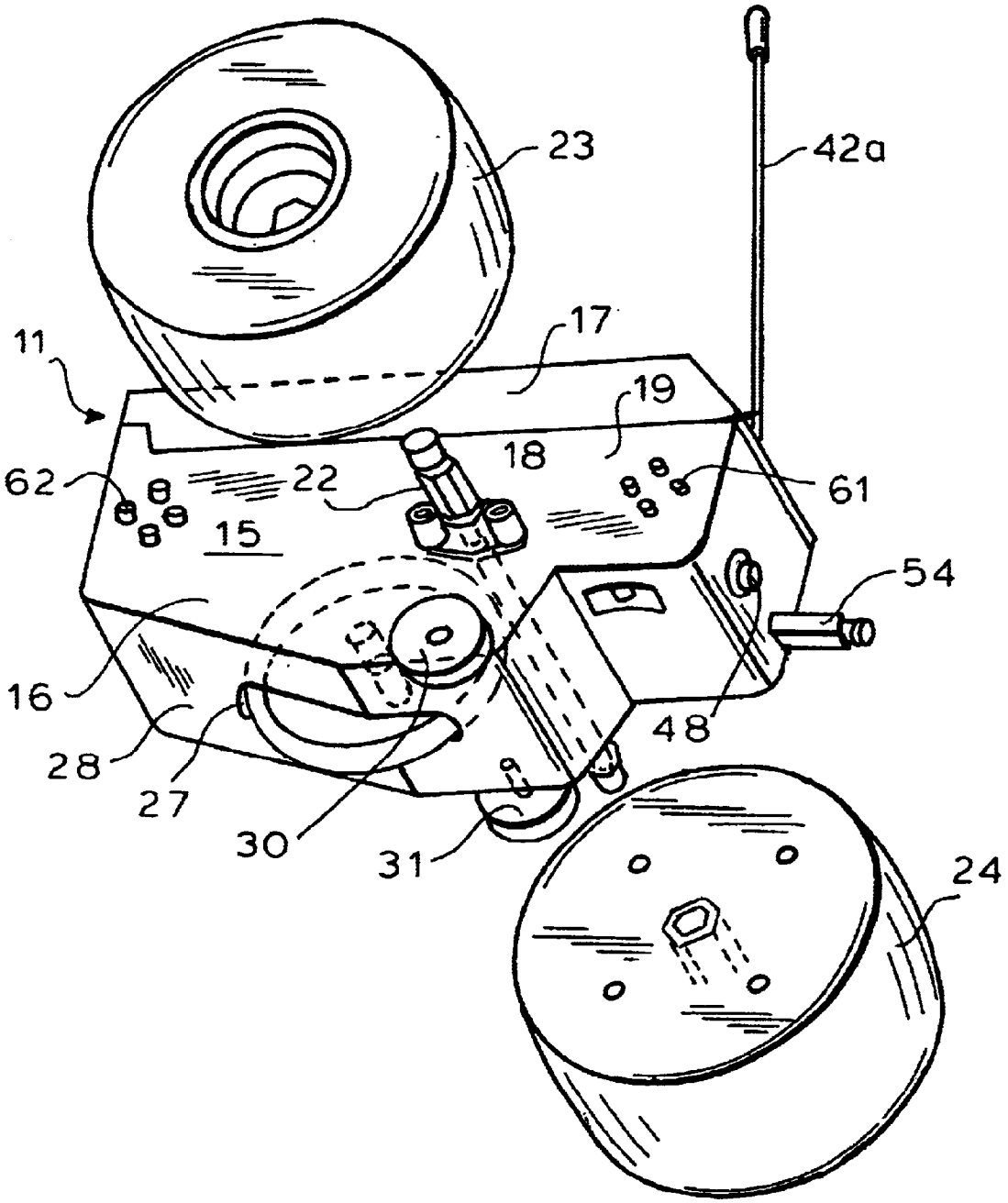
FIG. 2 is a partially exploded perspective view illustrating features of a chassis unit forming a significant part of the invention.
Figures 3, 6:
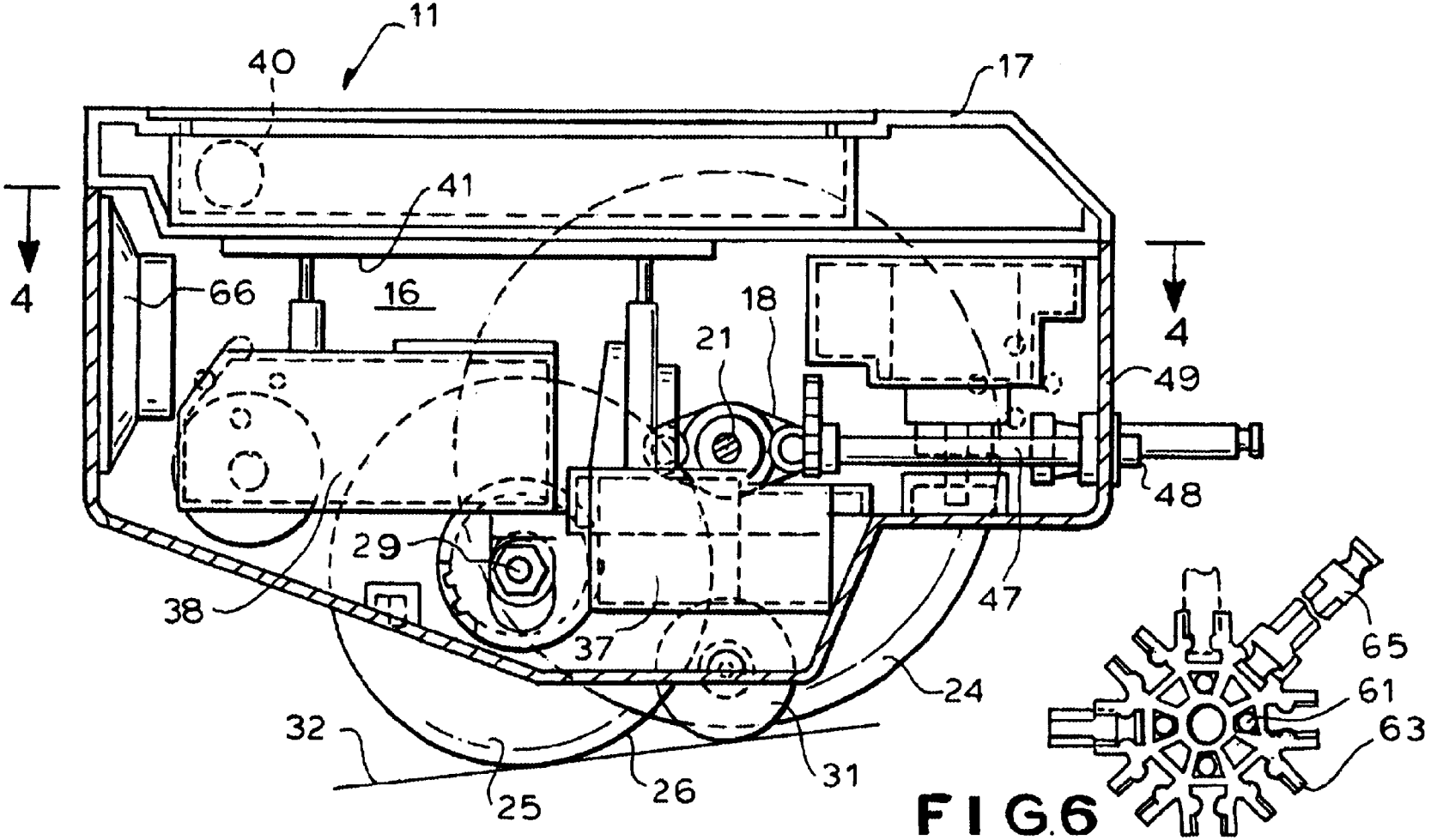
FIG. 3 is a side elevational view of the chassis unit of FIG. 2, with parts broken away to illustrate internal arrangements.
FIG. 6 is a fragmentary elevational view illustrating a representative form of "K'NEX" connector with rods joined therewith.
Figure 4:
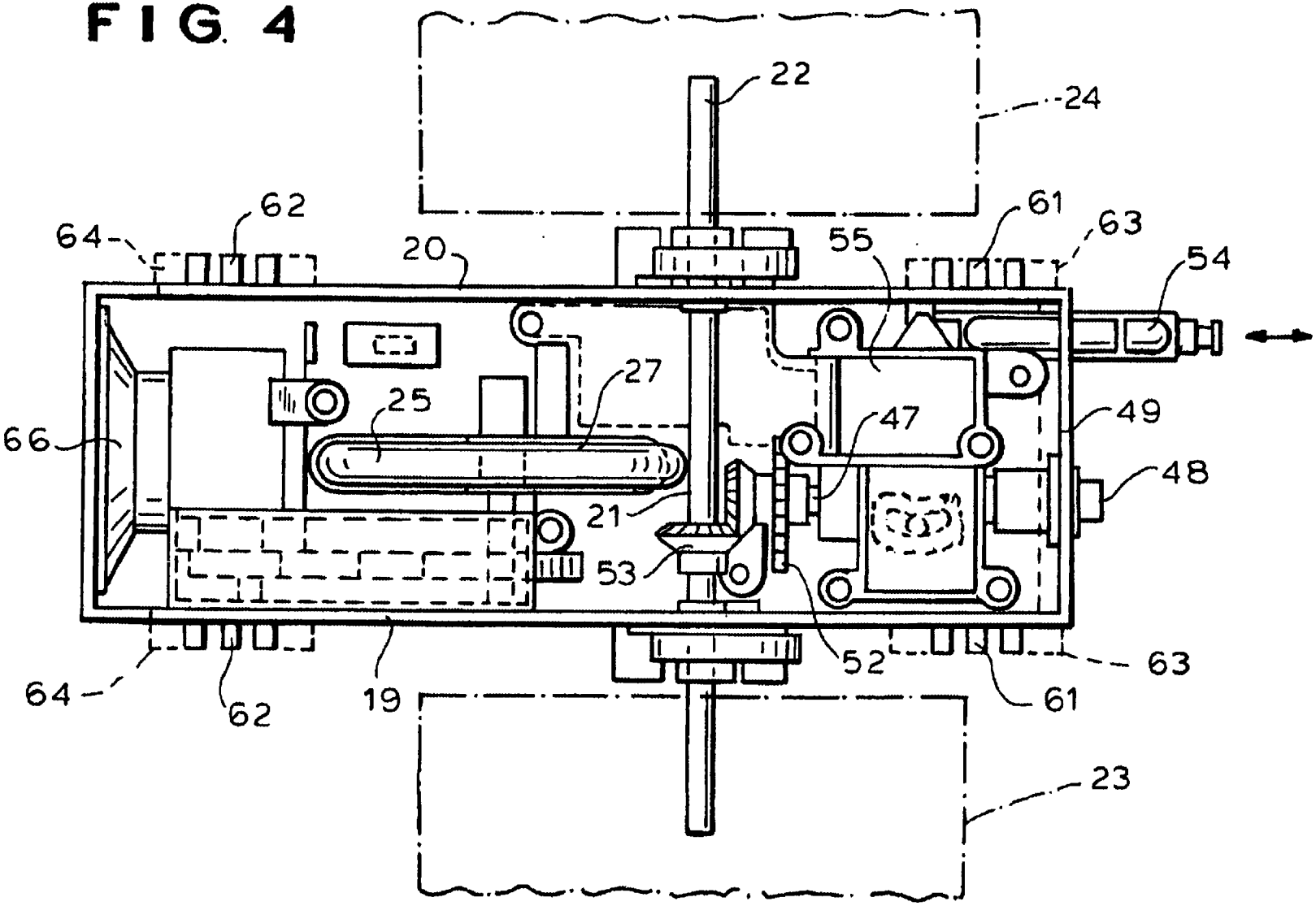
FIG. 4 is a cross-sectional view as taken generally on line 4—4 of FIG. 3.

A preferred form of the drive mechanism, shown in FIGS. 2–4, comprises a housing 15 having a bottom part 16, and a removable cover part 17. The lower housing part 16 mounts bearings 18 on its opposite side walls 19, 20. A main axle 21 extends through the lower housing part 16 and is journaled by the bearings 18. End portions 22 of the axle 21 are arranged to mount large simulated main drive wheels 23, 24. The particular attachment of the wheels is not significant, it being understood that there typically is a snap-connection, with interlocking means between the axle and the wheels such that rotations of the axle are transmitted to the wheels.

An actual drive wheel 25 is mounted centrally within the housing bottom 16 and is arranged to have a lower peripheral portion 26 projecting through an elongated opening 27 formed in the bottom wall 28 of the housing. The mounting and location of the actual drive wheel 25, with its rotational axis 29 located within the housing bottom 16 and with the wheel centrally positioned with respect to the housing side walls 19, 20, substantially conceals the actual drive wheel when the vehicle is viewed from above.

In a preferred embodiment of the invention, a pair of free rotating stabilizing wheels 30, 31 are mounted to the opposite side walls 19, 20 of the main housing, in a position more or less directly below the main wheels 23, 24. As shown in FIG. 3, the lower peripheral portions of the stabilizing wheels 30, 31 extend slightly below the lower peripheral portions of the main wheels 23, 24. The arrangement is such that, when the drive mechanism, in a stand-alone configuration, is placed upon a support surface 32, the drive wheel 25 and stabilizing wheels 30, 31 support main wheels 23, 24 slightly above the level of the support surface. This enables the main wheels 23, 24 to be rotated without causing the drive mechanism to be moved along the surface 32.

When the drive mechanism is in a stand-alone configuration, as shown in FIG. 3, the actual drive wheel 25 and the stabilizing wheels 30, 31 form a tripod support for the drive mechanism. In typical practice, a forward structure 34 is assembled to the drive mechanism 11. This forward structure includes front wheels 35, 36. In the fully constructed race car, as shown in example FIG. 1, the race car typically is supported at three points, consisting of the front wheels 35, 36 and the actual drive wheel 25, with the stabilizing wheels 31, 30 (as well as the simulated main drive wheels 23, 24) being slightly elevated from the support surface. In the fully assembled configuration, the stabilizing wheels contact the supporting surface 32 only when the main drive unit becomes tilted as might happen when the vehicle is in motion.

In accordance with one aspect of the invention, separate drive motors 37, 38 are provided for the simulated drive wheels 23, 24 and the actual drive wheel 25, respectively. These motors are separately controllable, so that the actual drive wheel and simulated drive wheels may be operated under separate control.

In the illustrated form of the invention, the upper portion 17 of the housing contains batteries 40 for powering the motors, as well as a circuit board 41 for applying the necessary control functions. The circuit arrangements are generally of a well-known type, and are disclosed herein only schematically. The circuitry included in the drive mechanism 11 is represented schematically in FIG. 5 and includes a radio receptor unit 42 with an antenna 42a adapted to receive radio control signals from a remotely located control pad 43. In the illustrated arrangement, the control pad 43 includes control levers 44, 45 which can be manipulated by the user. The lever 45 is movable from side to side, and is used for steering control as will be further described. Lever 44 has multiple functions. When the lever 44 is pushed part way forward, drive motor 37 is actuated by itself to simulate a "burn-out" of the simulated drive wheels 23, 24. Pushing the lever 44 farther forward activates the main drive motor 38 so that the vehicle is driven forward by the actual drive wheel 25, while the simulated drive wheels 23, 24 continue to rotate. Moving the lever 44 in the reverse direction actuates the motor 38 to operate the drive wheel 25 in reverse.

It is also contemplated that a staging sequence can be provided by operation by a single control button 46 on the remote control pad. Pressing the button 46 activates the motor 37 to effect a timed "burn-out" rotation of the simulated drive wheels 23, 24 for a period of, for example, one second. Thereafter, the motor 38 will also be actuated for a timed period, for example, a half second, to send a vehicle on its way after which both of the wheel drive motors 37 and 38 are deactivated.

To advantage a power takeoff shaft 47 is driven by the motor 37, and has a portion 48 projecting forwardly through the front wall 49 of the lower drive housing. The portion 48 of the power takeoff shaft advantageously is in the form of a socket for receiving and gripping the end of a "K'NEX" construction toy rod. In a typical constructed race car assembly, this power takeoff is utilized to rotate elements of a simulated engine 51 positioned directly in front of the drive mechanism 11. In the form of the invention illustrated herein, the power takeoff shaft 47 is driven directly by the motor 37 by means of a gear 52 (FIG. 4) and serves to drive the main axle 21 through a set of bevel gears 53.

The illustrated form of the invention also includes a linearly movable actuator element 54 which projects through the front wall 49 of the drive mechanism. The actuator rod is driven by a motor 55 and operates through a limited stroke in a front to back direction, according to actuation of the motor 55 by the remote control lever 45. In the completed race car vehicle, the actuator element 54 is joined by "K'NEX" construction toy rods and connectors to a steering assembly (not shown) associated with the front wheels 35, 36 such that, upon manipulation of the lever 45 and corresponding actuation of the motor 55, the front wheels 35, 36 can be steered left to right as desired.

Figure 5:
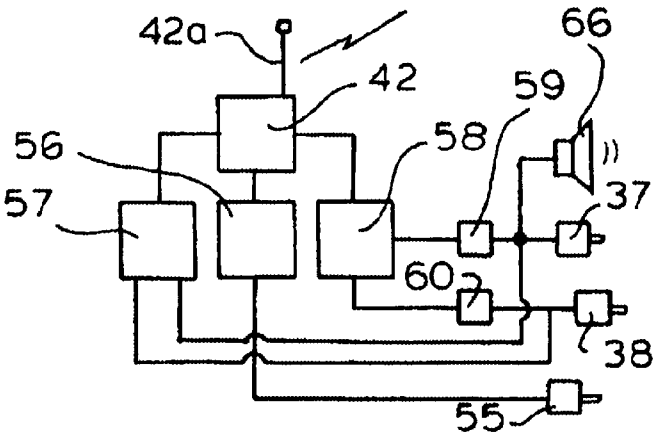
FIG. 5 is a simplified schematic representation of an advantageous form of control system for use with the mechanism of the invention.

The receptor unit 42 of the radio control system contained within the drive mechanism 11 is shown schematically in FIG. 5. The control system includes three control sections 56–58, the activation of which is a function of signals received from the control pad 43. The control section 56 is actuated by the control pad lever 45 and actuates the steering motor 55, in one direction or the other, depending upon operation of the lever 45. The control section 57 responds to actuations of the control lever 44 of the control pad. When the control lever 44 is moved in the forward direction in the intermediate position, the motor 37 is actuated to spin the simulated main drive wheels 23, 24. Continued movement of the lever 44 to a full forward position additionally actuates the motor 38 for driving the actual drive wheel 25, while continuing actuation of the motor 37. Operation of the lever 44 in the reverse direction (downward as shown in FIG. 1) activates the motors 37, 38 in a reverse direction for backing up.

Control section 58 is actuated by pressing of the timer button 46 on the control pad. This operates timers 59, 60, which function to actuate the drive motor 37 immediately for simulated "burn-out." After a limited period, for example, one second, the timer 60 actuates the motor 38 for operation of the actual drive wheel 25. After a short burst, for example, one-half second, both timers 59 and 60 time out de-energize the motors 37, 38.

To enable incorporation of the self-contained drive mechanism 11 into a vehicle formed of construction toy components, the side walls 19, 20 of the housing part 16 advantageously are provided adjacent the front and back portions thereof with studs 61, 62 which are adapted to receive a multi-socket connector element, indicated schematically at 63, 64 in FIG. 4 and in fragmentary view in FIG. 6. The connectors 63, 64 and associated rods 65 for joining therewith advantageously may be standard "K'NEX" components, generally in the form shown in the Glickman U.S. Pat. No. 5,061,219 and or 5,199,919, the disclosures of which are incorporated herein by reference. The mounting of such connectors on studs 61, 62 is shown in the Zimmer et al. U.S. Pat. No. 5,738,558, also incorporated herein by reference.

Upon mounting of connectors 63, 64 to opposite sides of the drive mechanism, an entire skeletal structure constituting the forward structure 34 of the vehicle may be assembled according to the desires and imagination of the builder. By means of the studs 62 and connector elements 64 at the back end of the drive mechanism 11, it is also possible to construct vehicle features at the back of the drive unit and/or over the top thereof. The builder, as will be understood, has a high level of freedom to construct and configure the vehicle to suit his or her individual desires.

In the mechanism of the invention, a racing sequence with simulated burn-out is initiated either by partial forward movement of the control lever 44, or by pressing of the sequencing button 46 to initiate rotation of the simulated main drive wheels 23, 24 while the actual drive wheel 25, and therefore the vehicle as a whole, remain stationary. Desirably, this burn-out action is accompanied by appropriate pre-recorded sounds, issued through a speaker 66 mounted within the housing 15. At the end of the burn-out, controlled either by a timer, in the case of the sequencing button 46, or by the operator, in the case of control applied through the lever 44, the drive motor 38 is activated to cause the vehicle to move forward along a desired path. Steering orientation of the front wheels 35, 36 can either be preset or controlled during operation by means of the control lever 45.

Because forward motion of the vehicle desirably is affected with considerable acceleration, the vehicle may tend to do a "wheelie", with the front wheels initially lifting off of the support surface. To accommodate this action, the rear portion of the drive unit housing 15 is tapered upwardly behind the actual drive wheel 25 to provide clearance for the drive unit to tilt.

The invention provides a unique and highly versatile drive mechanism for a toy racing vehicle, which enables a simulated "burn-out" phase, followed by forward motion of the vehicle. The simulated main drive wheels are elevated just slightly off of the support surface so that they can spin realistically, without advancing the vehicle. A separately driven and controlled actual drive wheel, substantially concealed underneath the drive mechanism is actuated after an initial spin of the simulated drive wheels, in order to advance the vehicle.

The construction of the drive mechanism is such that it forms a stand-alone unit which is self supporting by means of the actual drive wheels and a pair of small stabilizing wheels. When the drive unit is constructed into a complete vehicle, by the addition of various rods and connectors, for example, the stabilizing wheels advantageously may be slightly elevated with the vehicle being supported by its front wheels and by the actual drive wheel projecting below the lower surfaces of the housing for the drive mechanism.

The drive mechanism is conveniently remotely radio controlled, providing for steering control, as well as "burn-out" simulation and forward and rearward motion. Additionally, a pre-determined time sequence provides for a timed period of simulated "burn-out" followed by a timed period of forward motion, in order to realistically simulate an actual drag race.

All of the drive mechanisms and control means for the drive mechanism are enclosed within a compact housing, which forms the stand-alone unit. This stand-alone unit thus can be combined with other structural elements in a wide variety of ways to achieve a variety of vehicle designs.

It should be understood, of course, that the specific form of the invention herein illustrated and described is intended to be represented as only, as certain changes made therein by persons skilled in the art without departing from the clear teachings of the invention. Accordingly, reference should be made to the following appended claims in determining the full scope of the invention.

We claim:

1. A drive mechanism for a toy racing car, which comprises (a) a chassis unit (b) a pair of simulated main drive wheels rotatably mounted on said chassis unit, (c) a first drive motor on said chassis unit for controllably rotating said simulated main drive wheels, (d) means for causing said simulated main drive wheels to be positioned at least slightly above a support surface at a start of a race sequence, (e) a control for said drive motor for initially causing said simulated main drive wheels to be rotated at a relatively high speed while positioned above said support surface to simulate an initial burn-out of said simulated main drive wheels and shortly thereafter causing said car to proceed along a race path.

2. A drive mechanism according to claim 1, wherein (a) said chassis unit includes an actual drive wheel located between said simulated main drive wheels and at least partly concealed beneath said chassis unit, (b) said actual drive wheel being positioned to have portions of peripheral surfaces thereof at least slightly below lowest portions of said simulated main drive wheels for causing said simulated main drive wheels to be elevated above said support surface.

3. A drive mechanism according to claim 2, wherein (a) a second drive motor is provided on said chassis unit for rotating said actual drive wheel, and (b) second control means are provided for controlling said second drive motor independently of said first drive motor.

4. A drive mechanism according to claim 2, wherein (a) said chassis unit is constructed in a form of a closed housing, (b) means within said housing for rotatably supporting said actual drive wheel, (c) said housing having an opening in a bottom wall thereof through which lower portions of said actual drive wheel project.

5. A drive mechanism according to claim 4, wherein (a) said housing includes spaced apart side wall portions, (b) said side wall portions having axially aligned openings, (c) a shaft extending through said axially aligned openings and projecting from each side of said housing, (d) said simulated main drive wheels being mounted on opposite end portions of said shaft.

6. A drive mechanism according to claim 4, wherein (a) a linear actuator element is mounted in said housing and projects forward from a front wall portion of said housing.

7. A drive mechanism according to claim 6 wherein (a) said toy racing car is provided with steerable front wheels, and (b) said linear actuator element is connected to said front wheels for controllably steering said car.

8. A drive mechanism according to claim 1, wherein (a) a power takeoff element is connected to said drive motor and extends through a forward wall of said chassis unit, (b) said power take off element being engageable with elements of a simulated engine for rotating said elements when said drive motor is operated.

9. A drive mechanism according to claim 1, wherein (a) a speaker is mounted in said chassis unit, (b) said speaker being activated with said drive motor for making engine sounds.

10. A drive mechanism according to claim 3, wherein (a) timer means are provided for activating said second drive motor a predetermined time after activation of said first drive motor.

11. A drive mechanism according to claim 10, wherein (a) said timer means deactivates said drive motors a predetermined time after activating one of said drive motors.

12. A drive mechanism according to claim 3, wherein (a) a radio-controlled remote control unit is provided for controlling said chassis unit, (b) said remote control unit includes a first control for said first drive motor and a second control for said second drive motor, (c) said first control having a condition operable to activate said first drive motor while excluding activation of said second drive motor.

13. A drive mechanism according to claim 2, wherein (a) said chassis unit is provided with a pair of stabilizing wheels, one at each side of said chassis unit, positioned inside of and partly concealed by said simulated main drive wheels, (b) said stabilizing wheels being positioned forward of said actual drive wheel and serving with said actual drive wheel to provide a stabilized support for said chassis unit.

14. A drive mechanism according to claim 1, wherein (a) said chassis unit has spaced apart side walls formed with connector mounts, (b) connector elements are secured to said connector mounts for attachment of rod elements for constructing elements of said toy racing car.

* * * * *